US012173971B2

(12) United States Patent
Horoszczak et al.

(10) Patent No.: US 12,173,971 B2
(45) Date of Patent: Dec. 24, 2024

(54) HELICAL FRACTAL HEAT EXCHANGER

(71) Applicant: Hamilton Sundstrand Corporation, Charlotte, NC (US)

(72) Inventors: Adam Horoszczak, Wrocław (PL); Piotr Sawicki, Bogdaniec (PL)

(73) Assignee: UTC AEROSPACE SYSTEMS WROCLAW SP. Z.O.O., Wroclaw (PL)

( * ) Notice: Subject to any disclaimer, the term of this patent is extended or adjusted under 35 U.S.C. 154(b) by 0 days.

(21) Appl. No.: 17/152,967

(22) Filed: Jan. 20, 2021

(65) Prior Publication Data

US 2021/0231379 A1 Jul. 29, 2021

(30) Foreign Application Priority Data

Jan. 24, 2020 (EP) ..... 20153692

(51) Int. Cl.
*F28D 7/02* (2006.01)

(52) U.S. Cl.
CPC ..... *F28D 7/022* (2013.01); *F28F 2210/02* (2013.01)

(58) Field of Classification Search
CPC ..... F28D 7/0033; F28D 7/022; F28D 7/0008; F28F 7/02; F28F 2210/02
See application file for complete search history.

(56) References Cited

U.S. PATENT DOCUMENTS 1,965,553 A * 7/1934 Lear ..... F25B 39/02 165/165
4,451,960 A * 6/1984 Molitor ..... B21D 53/027 228/183
10,267,515 B2 4/2019 Adriany et al.
2017/0030651 A1 2/2017 Rock, Jr. et al.
2017/0205146 A1* 7/2017 Turney ..... F28D 7/0033
(Continued)

FOREIGN PATENT DOCUMENTS

EP 3124906 A1 2/2017
EP 3228971 A1 10/2017
(Continued)

OTHER PUBLICATIONS

Integration of Constructal Distributors to a Mini Crossflow Heat Exchanger, Chemical Engineering Science (Year: 2007).*
(Continued)

*Primary Examiner* — Eric S Ruppert
(74) *Attorney, Agent, or Firm* — CANTOR COLBURN LLP

(57) ABSTRACT

A helical fractal heat exchanger comprises a heat exchanger core defining a plurality of helical, first fluid conduits arranged in a two-dimensional grid configuration, and plurality of helical, second fluid conduits in thermal communication with the first fluid conduits. A first fluid inlet structure splits a first fluid from a first fluid inlet of the heat exchanger and supplies it to each of the plurality of first fluid conduits, and a first fluid outlet structure recombines the first fluid from the plurality of first fluid conduits and conveys it to a first fluid outlet of the heat exchanger. The first fluid inlet and outlet structures are each fractal structures comprising at least two multi-furcation stages in which a parent channel divides into two or more sub-channels that diverge away from each other.

15 Claims, 7 Drawing Sheets

(56) References Cited

U.S. PATENT DOCUMENTS

| | | | | |
|---|---|---|---|---|
| 2017/0248372 | A1 | 8/2017 | Erno et al. | |
| 2017/0292791 | A1* | 10/2017 | Zaffetti | F28F 9/0202 |
| 2019/0063842 | A1 | 2/2019 | Lopes | |

FOREIGN PATENT DOCUMENTS

| | | | |
|---|---|---|---|
| GB | 588520 | A | 5/1947 |
| WO | 2011115883 | A2 | 9/2011 |
| WO | 2019171078 | A1 | 9/2019 |

OTHER PUBLICATIONS

European Search Report for Application No. 20153692.7, mailed Jul. 28, 2020, 6 pages.

* cited by examiner

HELICAL FRACTAL HEAT EXCHANGER

FOREIGN PRIORITY

This application claims priority to European Patent Application No. 20153692.7 filed Jan. 24, 2020, the entire contents of which is incorporated herein by reference.

TECHNICAL FIELD

The present invention relates to a heat exchanger and to a method of manufacturing a heat exchanger.

BACKGROUND

Heat exchangers for transfer of heat between different fluids are widely used and exist in various forms. Typically heat exchangers are arranged for flow of a primary fluid and a secondary fluid with heat being transferred between the two fluids as they flow through the heat exchanger. Heat exchangers are required within aircraft structures to regulate temperatures of working fluids as well as to scavenge heat from one system for use in another. Every heat exchanger consumes significant space within an aircraft structure, and in certain areas of the aircraft structure space is at a premium.

A need therefore exists to provide a heat exchanger design which can optimise heat transfer whilst minimising the volume of the heat exchanger.

SUMMARY OF INVENTION

The present invention provides a heat exchanger comprising: a heat exchanger core defining a helical, first fluid flow path and a helical, second fluid flow path in thermal communication one another, wherein the first fluid flow path comprises a plurality of first fluid conduits arranged in a two-dimensional grid configuration; a first fluid inlet structure for supplying a first fluid from a first fluid inlet to the plurality of first fluid conduits; and a first fluid outlet structure for supplying the first fluid from the plurality of first fluid conduits to a first fluid outlet, wherein the first fluid inlet and outlet structures each comprise at least two multifurcation stages in which a parent channel divides into two or more sub-channels that diverge away from each other.

This configuration provides a high heat exchange efficiency within a compact volume because the helical flow path gives a long heat exchange length, and use of a grid of small first fluid conduits gives a large heat exchange surface.

The heat exchanger core may comprise a homogenous block of material defining the first fluid flow path and the second fluid flow path extending therethrough. The heat exchanger core may have been formed by additive manufacture.

The two-dimensional grid of first fluid conduits may comprise at least two rows of first fluid conduits and at least two columns of first fluid conduits. The rows and columns may extend perpendicularly. The rows may extend in a radial direction and the columns may extend in an axial direction. Optionally, the grid may comprise at least four rows of first fluid conduits, and further optionally may comprise at least six rows of first fluid conduits. Optionally, the grid may comprise at least five columns of first fluid conduits, further optionally may comprise at least ten columns of first fluid conduits, and yet further optionally may comprise at least fifteen columns of first fluid conduits.

The two-dimensional grid of first fluid conduits preferably comprises at least twenty (20) first fluid conduits, and may comprise at least fifty (50) first fluid conduits, and yet further may comprise at least ninety (90) first fluid conduits.

The arrangement of the first fluid conduits may remain substantially constant along the length of the first fluid flow path through the heat exchanger core. The plurality of first fluid conduits may be substantially continuous within the heat exchanger core. That is to say, such that a fluid in each of the first fluid conduits cannot mix with a fluid in any of the other first fluid in any of the other first fluid conduits within the heat exchanger core.

The plurality of first fluid conduits may each be connected to adjacent first fluid conduits within the heat exchanger core along their length. This may support the first fluid conduits to protect them from vibration damage or the like. The first fluid conduits. For example, each first fluid conduit may be connected to each adjacent first fluid conduit. That is to say, each first fluid conduit may be connected to the first fluid conduits axially above, axially below, radially inward and radially outward of that first fluid conduit.

The heat exchange core may define a plurality of concentric cylindrical ribs, which may be defined by walls of the first fluid conduits and axial connections between the first fluid conduits. The cylindrical ribs may be substantially impermeable to the first and second fluids. A radially inner cylindrical rib of the plurality of ribs may define an inner boundary of the first fluid flow path and/or the second fluid flow path. A radially outer cylindrical rib of the plurality of ribs may define an outer boundary of the first fluid flow path and/or the second fluid flow path. Optionally, the plurality of cylindrical ribs may comprise one or more cylindrical ribs between the radially inner cylindrical rib and the radially outer cylindrical rib.

The heat exchange core may define a plurality of helical, radial ribs, which may be defined by walls of the first fluid conduits and radial connections between the first fluid conduits. The helical ribs may be substantially impermeable to the first and second fluids. An axially upper helical rib of the plurality of ribs may define an upper boundary of the first fluid flow path and/or the second fluid flow path. An axially lower helical rib of the plurality of ribs may define a lower boundary of the first fluid flow path and/or the second fluid flow path. Optionally, the plurality of helical ribs may comprise one or more helical ribs between the axially upper rib and the axially lower rib.

The second fluid path may comprise a helical flow area surrounding the first fluid. The second fluid path may comprise a plurality of second fluid conduits. The second fluid conduits may be defined by the walls of the first fluid conduits, and by plurality of cylindrical ribs and the plurality of radial ribs. Each first fluid conduit may share a wall with one or more second fluid conduits.

The second fluid conduits may be arranged in a grid, which may be interspersed between the first fluid conduits. In one example, the first and second fluid conduits may be arranged in rows and columns, such that the rows and columns each alternate between a first fluid conduit and a second fluid conduit. The orientation of these rows and columns may be 45° offset with respect to an orientation of the grid of the first fluid conduits.

The first fluid conduits may each have a circular cross-section. Alternatively, the first and second fluid conduits may each have a square cross-section, a rectangular cross-section or a diamond cross-section, so as to maximise the number of conduits within the available space.

A first multi-furcation stage of either or both of the first fluid inlet structure and the first fluid outlet structure may comprise a single parent channel that divides into at least two (2) sub-channels, optionally at least four (4) sub-channels and further optionally at least ten (10) sub-channels. The sub-channels of the first multi-furcation stage may extend substantially parallel to one another. The sub-channels of the first multi-furcation stage may be arranged in a two-dimensional grid, which may comprise at least two rows and at least two columns.

A second multi-furcation stage of either or both of the first fluid inlet structure and the first fluid outlet structure may comprise a plurality of parent channels that each divides into at least two (2) sub-channels, optionally at least four (4) sub-channels and further optionally at least nine (9) sub-channels. Each parent channel of the second multi-furcation stage may correspond to one of the sub-channels of the first multi-furcation stage. Optionally, each parent channel of the second multi-furcation stage may divide into the same number of sub-channels. Optionally, each of the parent channels of the second multi-furcation stage may divide at the same location along the length of the structure.

For each parent channel of the second multi-furcation stage, the plurality of sub-channels may extend substantially parallel to one another. Optionally, all of the sub-channels of the second multi-furcation stage may extend substantially parallel to one another, i.e. the sub-channels from different parent channels are parallel with one another.

Optionally, further multi-furcation stages may be present.

Each sub-channel of a final one of the multi-furcation stages (e.g. the second multi-furcation stage) may be connected to a respective one of the plurality of first fluid conduits. Thus, the sub-channels of the final one of the multi-furcation stages may be arranged in a two-dimensional grid, which may comprise at least two (2) rows and at least two (2) columns. A dimension of the grid of the sub-channels may correspond to the dimensions of the grid of plurality of first fluid conduits.

A spacing between the sub-channels may be equal to a spacing between the plurality of first fluid conduits. Alternatively, a spacing between the sub-channels may be greater than a spacing between the plurality of first fluid conduits, and the sub-channels may converge as they approach the plurality of first fluid conduits.

The first fluid inlet and the first fluid outlet may be provided at a first axial end of the heat exchanger.

The first fluid inlet structure may extend axially along the outside of the heat exchanger core, so as to supply the first fluid to the heat exchanger core at a second axial end of the heat exchanger, which is opposite to the first axial end.

The first fluid outlet structure may recover the first fluid from the heat exchanger core at the first axial end of the heat exchanger, which is opposite to the first axial end.

One or both of the first fluid inlet structure and the first fluid outlet structure may be formed integrally and homogeneously with the heat exchanger core. Optionally, the first fluid inlet structure, the first fluid outlet structure and the heat exchanger core may have been formed integrally by additive manufacture.

The heat exchanger may comprise a second fluid inlet structure. The second fluid inlet structure may be for supplying a second fluid to the second fluid flow path. The second fluid inlet structure may be configured to supply the second fluid to the heat exchanger core proximate the first fluid outlet structure.

The heat exchanger may comprise a second fluid outlet structure. The second fluid inlet structure may be for supplying the second fluid from the second fluid flow path to a second fluid outlet. The second fluid outlet structure may be configured to recover the second fluid from the heat exchanger core proximate the first fluid inlet structure. The second fluid outlet structure may be configured to recover the second fluid from the heat exchanger core at the second end of the heat exchanger.

The second fluid outlet structure may comprise a second fluid conduit which extends along a central axis of the heat exchanger core. The second fluid outlet structure may be shaped to guide the second fluid from a final pass of the helical second fluid flow path into the second fluid conduit. For example, the second fluid outlet structure may comprise a plurality of ribs, which may spiral inwardly towards the conduit. The ribs may be formed integrally with the heat exchanger core. The ribs may direct the second fluid so as to cross the first fluid conduits.

Optionally, the second fluid inlet structure, the second fluid outlet structure and the heat exchanger core may have been formed integrally by additive manufacture. Further optionally, the first fluid inlet structure, the first fluid outlet structure, the second fluid inlet structure, the second fluid outlet structure and the heat exchanger core may have been formed integrally by additive manufacture.

Any one or more or all of the components of the heat exchanger may be formed from any one of: a polymer, a steel, aluminium or an aluminium alloy, nickel or a nickel alloy, titanium or a titanium alloy, and a superalloy.

A method of manufacturing the heat exchanger may comprise forming the heat exchanger using additive manufacture.

BRIEF DESCRIPTION OF FIGURES

Embodiments of the invention are described below by way of example only and with reference to the accompanying drawings, in which.

DETAILED DESCRIPTION OF FIGURES

Figure 1:
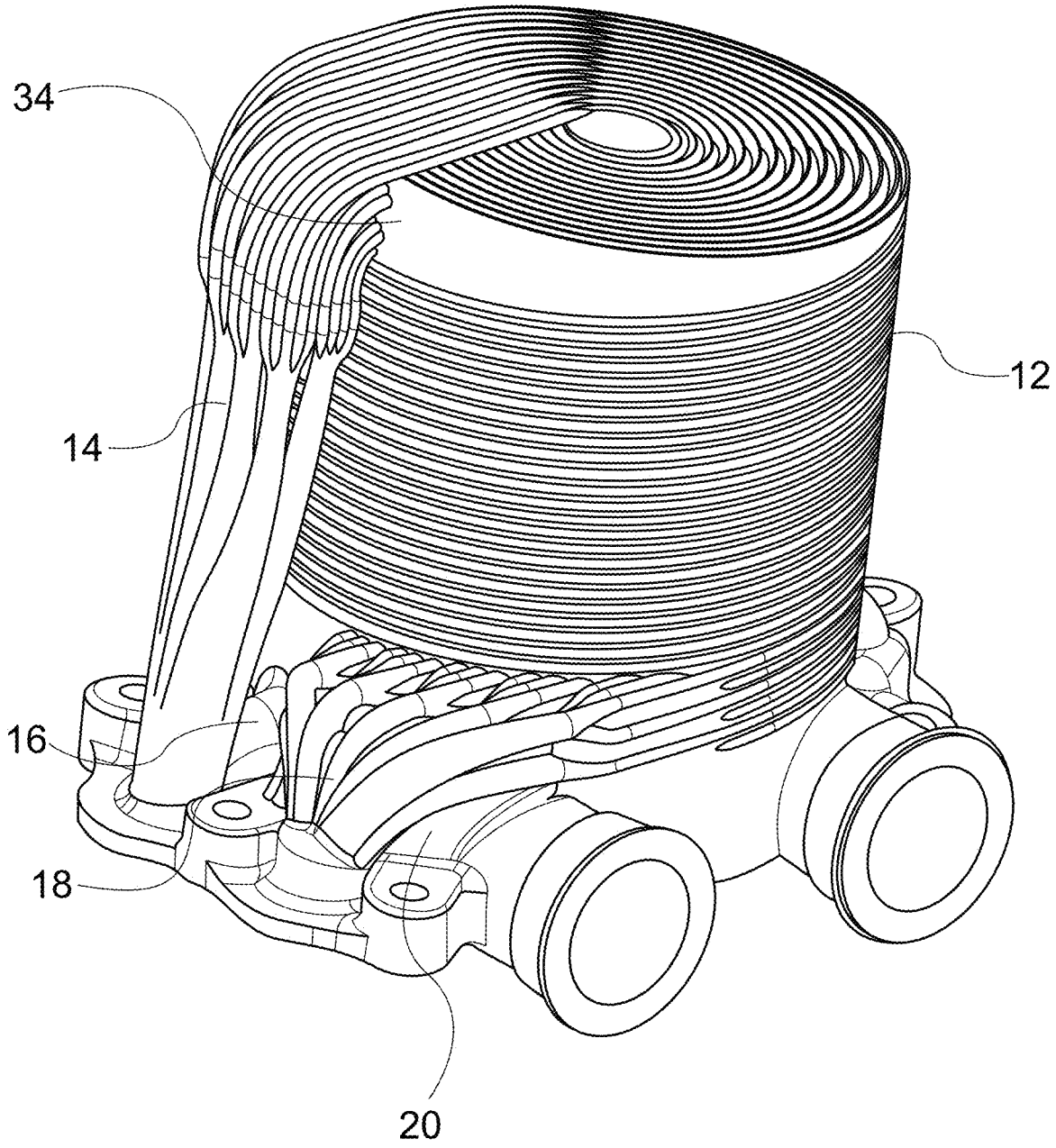
FIG. 1 shows a helical heat exchanger.

FIG. 1 shows a heat exchanger 10 arranged to exchange thermal energy between a first fluid and a second fluid, whilst preventing the first fluid and second fluids from mixing with one another.

The illustrated heat exchanger 10 is designed for fuel-oil heat exchange on an aircraft, where the first fluid is hot oil and the second fluid is cool fuel. However, the heat exchanger may alternatively be employed for heat exchange between any two fluids.

Figure 2:
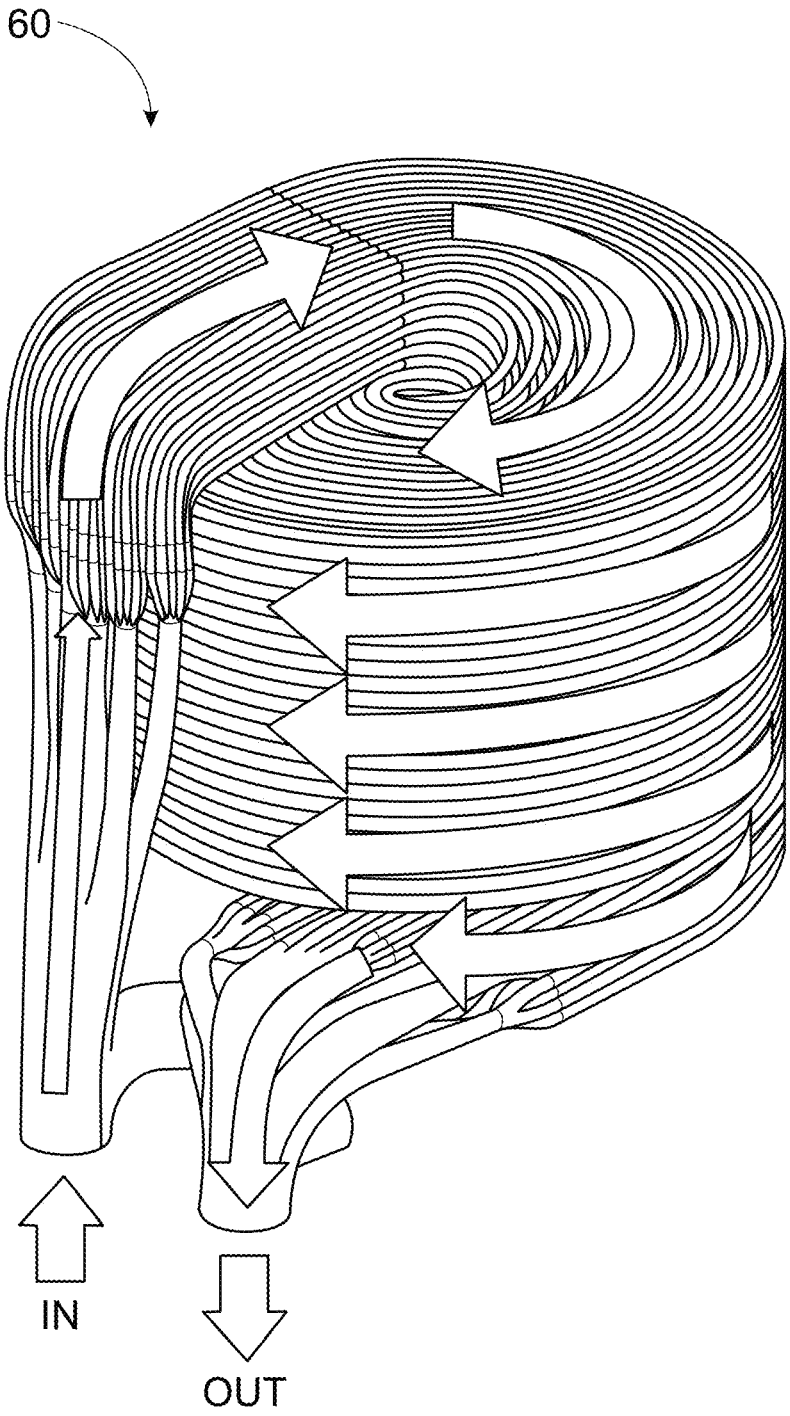
FIG. 2 shows the hot fluid flow path through the heat exchanger.
Figure 3:
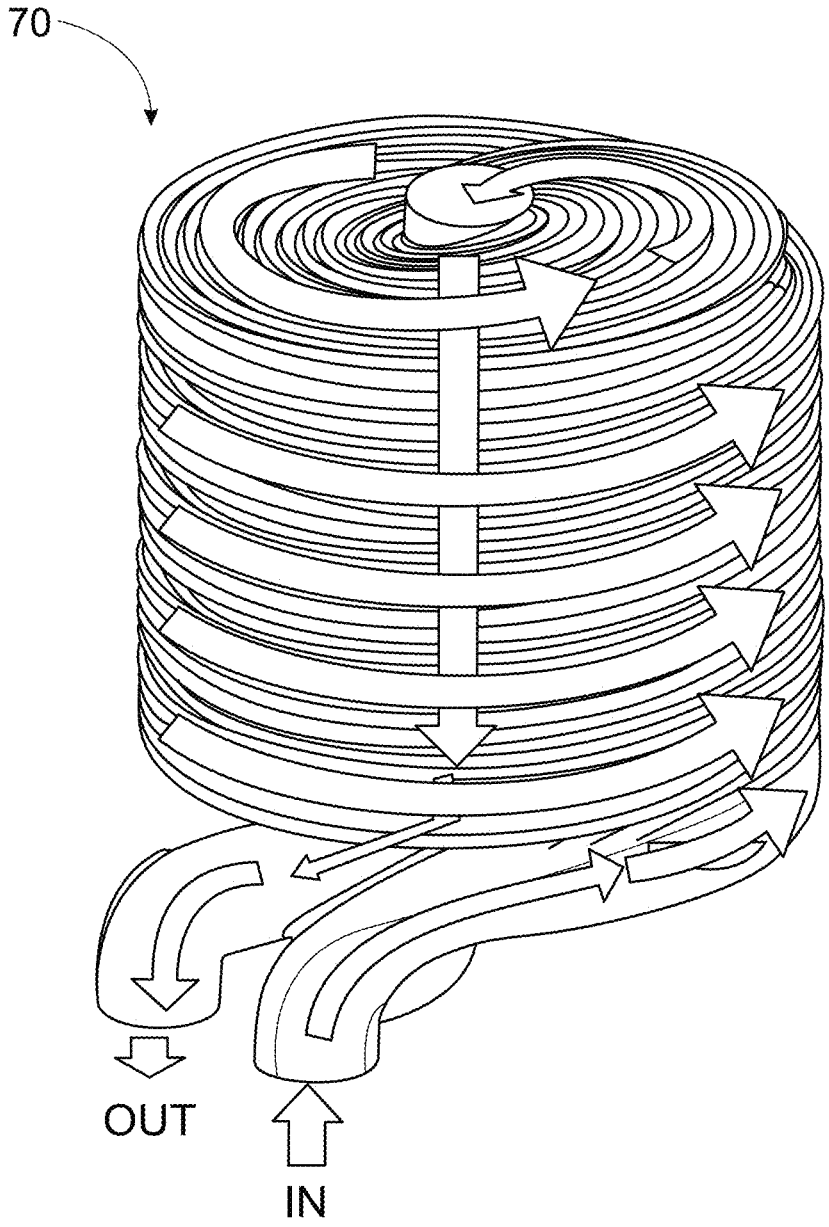
FIG. 3 shows the cold fluid flow path through the heat exchanger.

The heat exchanger 10 defines a first fluid path 60 and a second fluid path 70, shown respectively in FIGS. 2 and 3. The first and second fluid paths 60, 70 flow in opposite directions through the heat exchanger 10, such that the heat exchanger 10 operates as a counter-flow heat exchanger.

The heat exchanger 10 comprises a heat exchanger core 12 where the first and second fluids are brought into thermal communication. The first and second fluid paths 60, 70 follow a common helical path through the heat exchanger core 12 in opposite directions.

The heat exchanger 10 further comprises a first fluid inlet structure 14 for supplying the first fluid from a first fluid inlet 16 to the heat exchanger core 12, and a first fluid outlet structure 18 for recovering the first fluid from the heat exchanger core 12 and supplying it to a first fluid outlet 20.

The heat exchanger 10 similarly comprises a second fluid inlet structure 22 for supplying the second fluid from a second fluid inlet 24 to the heat exchanger core 12, and a second fluid outlet structure 26 for recovering the second fluid from the heat exchanger core 12 and supplying it to a second fluid outlet 28. These structures are not visible in FIG. 1.

Figure 4:
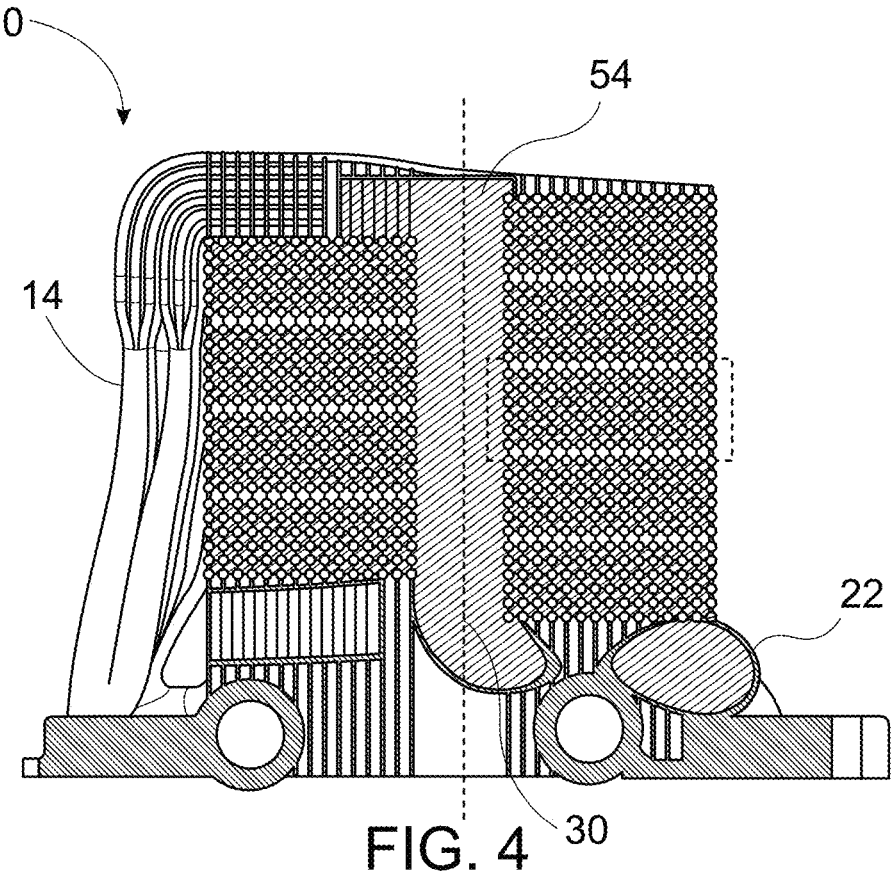
FIG. 4 shows a cut-away view of the heat exchanger.

FIG. 4 shows a cross-sectional view through the heat exchanger core 12.

The heat exchanger core 12 defines a helical flow path comprising a plurality of passes or turns around a central axis 30. In the illustrated example the helical flow path follows a right-handed helix comprising four and a half passes around the central axis 30, i.e. such that the first fluid enters and exits from the same side.

Figure 5:
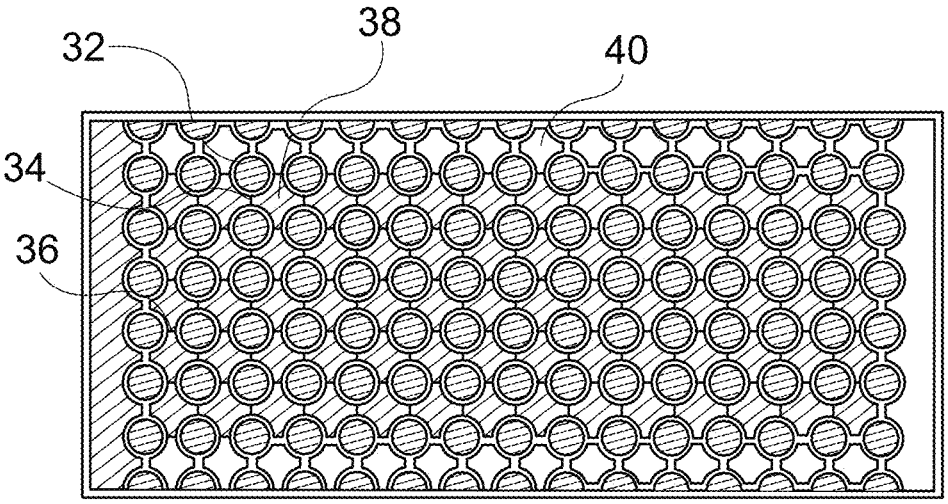
FIG. 5 shows a detailed cut-away view of the heat exchanger.

Except for a short distance at either end of the helical flow path, which will be described in greater detail later, the helical flow path of the heat exchanger core 12 has a substantially constant cross-sectional construction along its length. Details of the cross-sectional construction of the flow path within the rectangle indicated in FIG. 4 are shown in FIG. 5.

The helical flow path of the heat exchanger core 12 comprises a plurality of first fluid conduits 32, which in this example each have a circular cross-section. In cross-section, the first fluid conduits 32 are arranged in a two-dimensional grid arrangement, which in the illustrated embodiment comprises six (6) conduits 32 in height (axial direction of the helical flow path) and fifteen (15) conduits 32 in width (radial direction of the helical flow path). Thus, each pass of the helical flow path comprises 90 first fluid conduits 32.

Each of the first fluid conduits 32 is continuous along the length of the helical flow path. Thus, each of the first fluid conduits 32 also follows a helical path with the same pitch as the helical flow path of the heat exchanger core 12 and a diameter based on the position of the first fluid conduit 32 within the array.

The first fluid conduits 32 are preferably each isolated from one another within the heat exchanger core 12, i.e. such that within the heat exchanger core 12 fluid in one first fluid conduit 32 cannot mix with fluid in another first fluid conduit 32.

Each first fluid conduit 32 is connected to the adjacent first fluid conduits 32 within the grid, i.e. the first fluid conduits 32 axially above, axially below, radially inward and radially outward.

These connections 34, 36 result in an arrangement of cylindrical ribs, defined by the walls of the first fluid conduits 32 and the axial connections 34, and an arrangement of radial, helical ribs, defined by the walls of the first fluid conduits and the radial connections 36. This arrangement supports the first fluid conduits 32 rigidly within the heat exchanger core 12, reducing the risk of vibration damage to the conduits 32.

The connections 34, 36 further define a plurality of second fluid conduits 38 between and adjacent to the first fluid conduits. At least the connections 34, 36 between the first fluid conduits 32 at the axially upper and lower ends of each pass of the helical flow path are continuous and uninterrupted to prevent the second fluid flowing between adjacent passes of the helical flow path, so as to maintain the counter-flow configuration. Similarly, the connections 34, 36 between the first fluid conduits at the radially inner and outer ends of each path are continuous and uninterrupted to prevent the second fluid leaving the heat exchanger 10.

In the illustrated embodiment, the remaining connections within the grid are also continuous and uninterrupted such that within the heat exchanger core 12 the second fluid in one second fluid conduit 38 cannot mix with fluid in another second fluid conduit 38.

The spaces between the lowermost first fluid conduits 32 in one of the helical flow path and the uppermost first fluid conduits 32 in an adjacent pass of the helical flow path may be filled by a dividing material 40. This may comprise the material of the heat exchanger core 12, or may alternatively be a thermally insulating material to insulate adjacent passes.

The use of a helical flow path allows for a long heat exchange length, which increases heat exchange efficiency, within a relatively compact space. In the present example, the heat exchanger 10 has dimensions of approximately 5 inches (12.7 cm) in axial length, 5 inches (12.7 cm) in width and 4 inches (10.1 cm) in depth, but provides an average channel length of about 60 inches (152 cm).

Similarly, using a large number of small first fluid conduits 32 increases the heat transfer surface area, which further increases heat exchange efficiency.

In this embodiment, the heat exchanger 10 uses counter flow so the first fluid and the second fluid travel in opposite directions. Counter flow is preferably utilised because the temperature difference will be more uniform along the length of the helical flow path than if parallel flow is utilised. This prevents the hottest fluid from being in contact with the coldest fluid and hence reduces the thermal stresses on the thin walls of the heat exchanger core 12.

Figure 6:
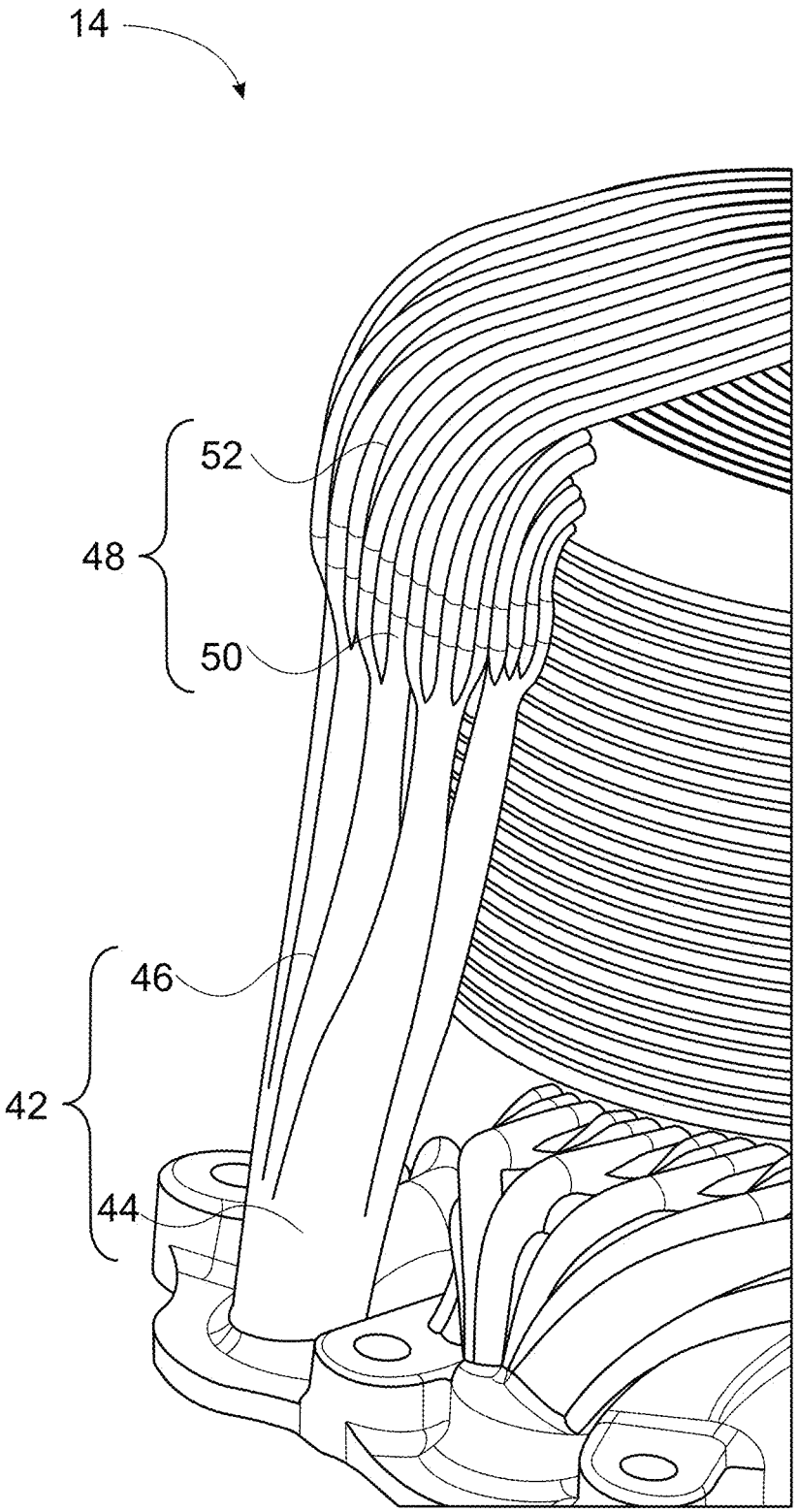
FIG. 6 shows a fractal inlet structure for the hot fluid.

FIG. 6 shows the first fluid inlet structure 14 of the heat exchanger 10.

The first fluid inlet structure 14 connects the first fluid inlet 16 of the heat exchanger 10 to each of the first fluid conduits 32 of the heat exchanger core 12, so as to divide the first fluid substantially evenly between the first fluid conduits 32.

The first fluid inlet structure 14 comprises a fractal channel. The term fractal channel here describes the repeated diverging structure of the channel, whereby the channel repeatedly splits into two or more smaller sub-channels along its length. Such structures are sometimes also known as multi-furcating channels.

The fractal channel comprises a plurality of fractal stages 42, 48. In each fractal stage 42, 48, one or more parent channels each subdivide into a plurality of sub-channels at respective divergence points.

The first fractal stage 42 comprises a parent channel 44 with the largest diameter, corresponding to the diameter of the first fluid inlet 16. The parent channel 44 of the first fractal stage 42 reaches a first divergence point where the parent channel 44 splits into ten (10) sub-channels 46, each having a smaller diameter than the parent channel 44. In the illustrated example, the ten sub-channels 46 are arranged in a grid-like array that is two (2) channels 46 high and five (5) channels 46 wide.

The ten sub-channels 46 of the first fractal stage 42 initially diverge away from each other and a central axis of the parent channel 44 of the first fractal stage 42. The sub-channels 46 each follow an S-shaped curved path such that after a given length the direction of the sub-channels 46 becomes parallel to the central axis of the parent channel 44 of the first fractal stage 42.

In the second fractal stage 48, each of the ten sub-channels 46 of the first fractal stage 42 forms a parent channel 50 of the second fractal stage 48. The second fractal stage 48 of the fractal channel thus comprises ten parent channels 50. When each parent channel 50 of the second fractal stage 48 reaches a second divergence point, they each split into nine sub-channels 52 which diverge and curve in the same way as the sub-channels 46 of the first fractal stage 42. The second fractal stage 48 thus comprises ninety (90) sub-channels.

The individual sub-channels 52 of the second fractal stage 48 each have a smaller diameter than individual sub-channels 46 of the first fractal stage 42. However, the total cross sectional flow area of the sub-channels within each particular fractal stage is substantially equal to the total cross sectional flow area of the parent channels within the fractal stage. Therefore the total cross sectional flow area through the fractal channel remains substantially constant. This prevents any pressure drop from occurring in the first fluid.

Whilst the illustrated embodiment comprises a fractal channel having only two fractal stages 42, 48, it will be appreciated that any number of fractal stages may be used. Preferably, within each fractal stage, each parent channel divides into the same number of sub-channels. Typically, for each fractal stage, the parent channels will divide into between 2 and 15 sub-channels.

The first fluid inlet structure 14 extends from a base of the heat exchanger 10 in an axial direction (with respect to the axis of the helical flow path of the heat exchanger core) adjacent to the heat exchanger core 12.

After the second fractal stage 48, the ninety sub-channels 52 each turn through an approximately 90° bend and extend approximately tangentially into the heat exchanger core 12. Each of the sub-channels 52 connects to a respective one of the first fluid conduits 32 of the heat exchanger core 12.

The first fluid inlet structure 14 supplies the first fluid to the heat exchanger core 12 adjacent to the outlet for the second fluid from the heat exchanger core 12. The second fluid is recovered from the heat exchanger core by a second fluid outlet structure 24.

The second fluid outlet structure 24 is integrated with the heat exchanger core 12. As shown in FIG. 3, the cylindrical ribs of the heat exchanger core 12 spiral inwards at the end of the final pass of the helical flow path, such that the ribs cross the paths of the tangential sub-channels of the first fluid inlet structure. The spiral-shaped portions of the ribs divert the second fluid in the second fluid channels 48 towards the central axis 30 of the heat exchanger core 12. The second fluid then flows along an axial channel 54 of the second fluid outlet structure, which extends through the centre of the heat exchanger core 12 along the central axis 30.

The axial channel 54 is defined by the heat exchanger core 12, and in particular by the walls of the radially-inner first fluid conduits 32 and the axial connections 34 between the radially-inner first fluid conduits 32.

The spacing between the ninety sub-channels 52 of the first fluid inlet structure 14 may be larger than the spacing between the ninety first fluid conduits 42, so as to allow for the second fluid to leave the second fluid conduits 48. Thus, the sub-channels 52 may converge as they approach the first fluid conduits 32.

Figure 7:
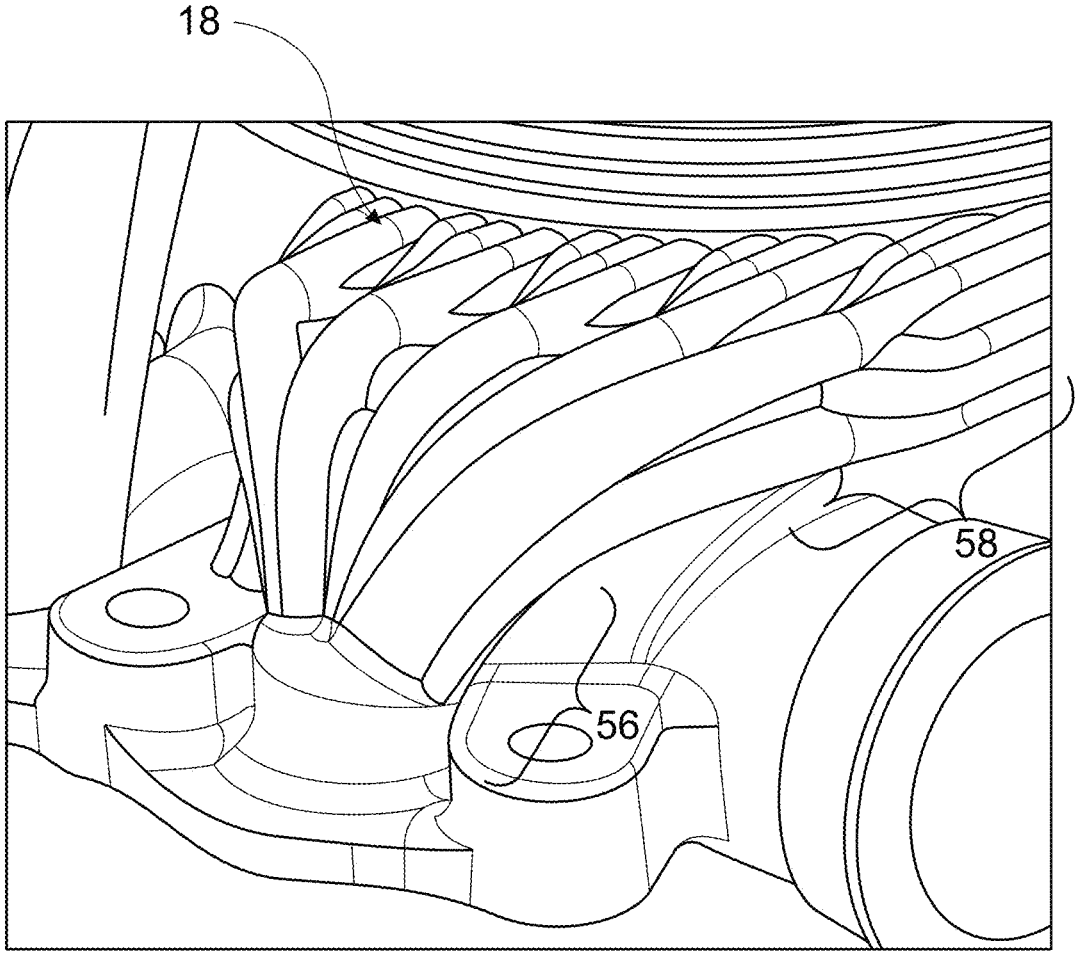
FIG. 7 shows a fractal outlet structure for the hot fluid.

FIG. 7 shows the first fluid outlet structure 18 of the heat exchanger 10.

The first fluid outlet structure 18 connects each of the first fluid conduits 32 of the heat exchanger core 12 to the first fluid outlet 20 of the heat exchanger 12, so as to recombine the first fluid from the first fluid conduits 32.

The first fluid outlet structure 18 comprises a fractal channel, comprising two fractal stages 56, 58 similar to the first fluid inlet structure 14. Thus, ninety sub-channels first converge to form ten parent channels in a second fractal stage 58, and these ten parent channels then form ten sub-channels that converge to form a single parent channel in a first fractal stage 56.

The first fluid inlet structure 18 extends from a base of the heat exchanger 12 a short distance in an axial direction (with respect to the axis of the helical flow path of the heat exchanger core). Between the first and second fractal stages 46, 48, the ten sub-channels of the first fluid outlet structure 18 each turn through an approximately 90° bend and extend approximately tangentially into the heat exchanger core 12. Each of the sub-channels connects to a respective one of the first fluid conduits 32 of the heat exchanger core 12.

The first fluid inlet structure 18 recovers the first fluid to the heat exchanger core 12 adjacent to the inlet for the second fluid to the heat exchanger core 12. The second fluid is supplied to the heat exchanger core 12 by a second fluid inlet structure 22, which is illustrated in FIG. 8.

Figure 8:
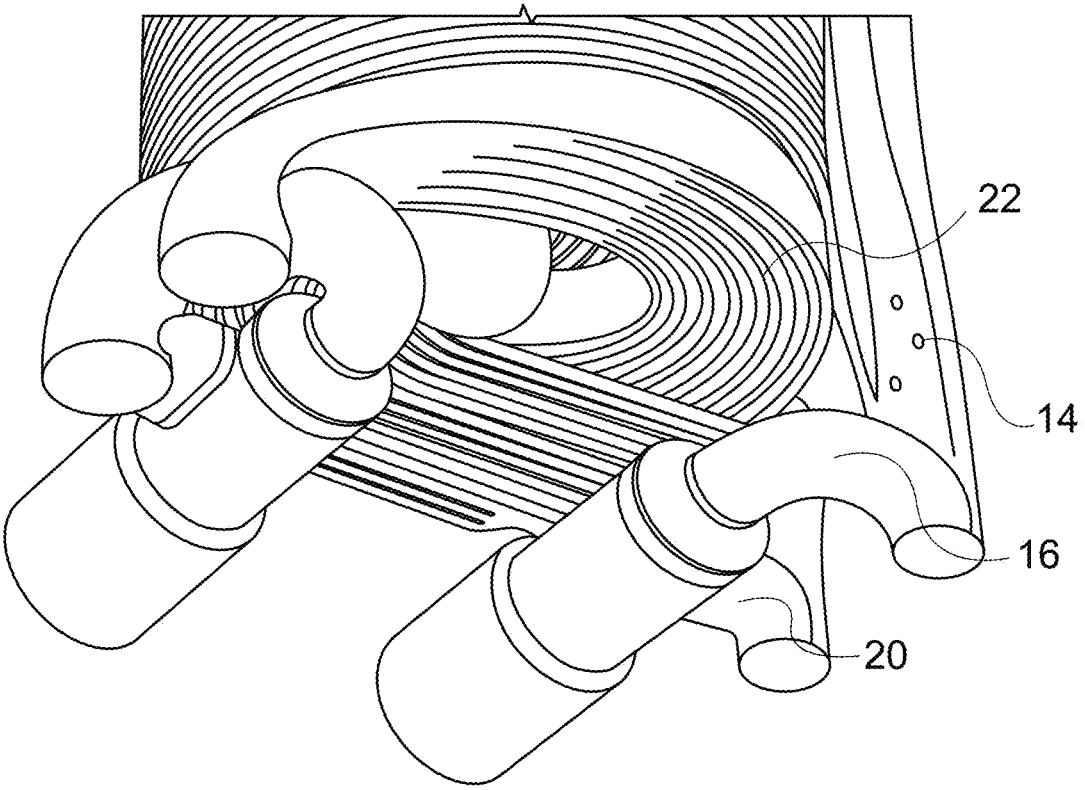
FIG. 8 shows an inlet structure for the cold fluid.

FIG. 8 shows the hot and cold flow paths when viewed from the underside of the heat exchanger 10.

The second fluid inlet structure 22 is similarly integrated with the heat exchanger core 12. The second fluid inlet structure 22 supplies the second fluid from a second fluid inlet to the heat exchanger core 12 along a helical flow path. Along the flow path, the flow is divided first by a first plurality of cylindrical ribs, and then by a second plurality of cylindrical ribs. The second fluid is then supplied to the second fluid conduits 38 of the heat exchanger core 12.

As with the second fluid outlet structure 26, the ribs of the second fluid inlet structure 22 cross the paths of the tangential sub-channels of the first outlet outlet structure 18. The spacing between the ninety sub-channels of the first fluid outlet structure 18 may be similarly be larger than the spacing between the ninety first fluid conduits 32, so as to allow for the second fluid to enter the second fluid conduits 38. Thus, the sub-channels of the first fluid outlet structure 18 may converge as they approach the first fluid conduits 32.

The heat exchanger 10 is arranged so that all of the first fluid and all of the second fluid passes respectively through the first and second channels 32, 38 of the heat exchanger core 12.

The heat exchanger 10 is particularly suited to manufacture by additive manufacturing as a single piece, due to the complex geometries of the heat exchanger core 12 and fractal first fluid inlet and outlet structures 16, 18.

The heat exchanger 10 can be printed by additive manufacture from any material suitable for the intended operating conditions. The type of material depends on the specific application of the heat exchanger 10.

Exemplary materials that may be used are aluminium, steel, nickel, alloys or titanium or superalloys such as Inconel 625. Aluminium may be suitable for low to medium temperature applications. Polymers may be suitable for low temperature applications. Polymers may also be used if it is desirable for the heat exchanger 12 to be flexible.

The invention claimed is:

1. A heat exchanger comprising:

a heat exchanger core defining a helical, first fluid flow path and a helical, second fluid flow path in thermal communication with one another, wherein the first fluid flow path comprises a plurality of first fluid conduits arranged cross-sectionally in a two-dimensional grid configuration comprising at least two rows and at least two columns of first fluid conduits in each pass of the helical first fluid flow path; and wherein the second fluid flow path comprises a helical flow area, wherein the second fluid flow path is surrounded by the first fluid conduits;

a first fluid inlet structure for supplying a first fluid from a first fluid inlet to the plurality of first fluid conduits; and a first fluid outlet structure for supplying the first fluid from the plurality of first fluid conduits to a first fluid outlet, wherein the first fluid inlet and outlet structures each comprise at least two multi-furcation stages, wherein, in each multi-furcation stage, a parent channel divides into two or more sub-channels that diverge away from each other, wherein the sub-channels are arranged in a two-dimensional grid comprising at least two rows and at least two columns, and wherein the two or more sub-channels of a first multi-furcation stage each correspond to a parent channel of a second multi-furcation stage.

2. A heat exchanger according to claim 1, wherein the heat exchanger core comprises a homogenous block of material defining the first fluid flow path and the second fluid flow path extending therethrough.

3. A heat exchanger according to claim 1, wherein the first fluid inlet structure and the first fluid outlet structure are formed integrally and homogeneously with the heat exchanger core.

4. A heat exchanger according to claim 1, wherein the two-dimensional grid of first fluid conduits comprises at least twenty first fluid conduits.

5. A heat exchanger according to claim 1, wherein the plurality of first fluid conduits are each connected to adjacent first fluid conduits within the heat exchanger core along their length.

6. A heat exchanger according to claim 1, wherein the heat exchange core defines a plurality of concentric cylindrical ribs, which are defined by walls of the first fluid conduits and axial connections between the first fluid conduits.

7. A heat exchanger according to claim 6, wherein the heat exchange core defines a plurality of helical, radial ribs, which are defined by walls of the first fluid conduits and radial connections between the first fluid conduits.

8. A heat exchanger according to claim 1, wherein the second fluid path comprises a plurality of second fluid conduits arranged in a grid cross-sectionally, and wherein the second fluid conduits are interspersed between the first fluid conduits.

9. A heat exchanger according to claim 1, wherein a first multi-furcation stage of the first fluid inlet structure or the first fluid outlet structure comprises a single parent channel that divides into at least four sub-channels arranged in a two-dimensional grid.

10. A heat exchanger according to claim 9, wherein a second multi-furcation stage of the first fluid inlet structure or the first fluid outlet structure comprises a plurality of parent channels corresponding to the sub-channels of the first multi-furcation stage, and wherein each of those parent channels divides into at least four sub-channels arranged in a two-dimensional grid.

11. A heat exchanger according to claim 1, wherein each sub-channel of a final one of the multi-furcation stages of the first fluid inlet structure and/or the first fluid outlet structure is connected to a respective one of the plurality of first fluid conduits, wherein a spacing between the sub-channels of the final multi-furcation stage is greater than a spacing between the plurality of first fluid conduits, and wherein the sub-channels of the final multi-furcation stage converge as they approach the plurality of first fluid conduits.

12. A heat exchanger according to claim 1, further comprising a second fluid outlet structure for supplying the second fluid from the second fluid flow path to a second fluid outlet, wherein the second fluid outlet structure comprises a second fluid conduit which extends along a central axis of the heat exchanger core, and wherein the second fluid outlet structure is shaped to guide the second fluid from a final pass of the helical second fluid flow path into the second fluid conduit.

13. A heat exchanger according to claim 12, wherein the second fluid outlet structure comprise a plurality of ribs formed integrally with the heat exchanger core, and which spiral inwardly towards the second fluid conduit.

14. A heat exchanger according to claim 1, wherein the heat exchanger is from any one of: a polymer, a steel, aluminium or an aluminium alloy, nickel or a nickel alloy, titanium or a titanium alloy, and a superalloy.

15. A method of manufacturing a heat exchanger comprising:

forming a heat exchanger according to claim 1 using additive manufacture.

* * * * *